US008020870B2

(12) United States Patent
Robuck, Jr.

(10) Patent No.: US 8,020,870 B2
(45) Date of Patent: Sep. 20, 2011

(54) PATTERN RECOGNITION AND DUPLICATION PROCESS AND GAME

(76) Inventor: Charlie K. Robuck, Jr., Wilmington, NC (US)

( * ) Notice: Subject to any disclaimer, the term of this patent is extended or adjusted under 35 U.S.C. 154(b) by 0 days.

(21) Appl. No.: 12/583,984

(22) Filed: Aug. 28, 2009

(65) Prior Publication Data

US 2011/0049803 A1 Mar. 3, 2011

(51) Int. Cl.
*A63F 3/00* (2006.01)

(52) U.S. Cl. ..... 273/271; 273/276; 273/155; 273/157 A

(58) Field of Classification Search ..... 273/271, 273/276, 273, 155, 156, 157 R, 157 A, 140, 273/148 A; 434/84, 98
See application file for complete search history.

(56) References Cited

U.S. PATENT DOCUMENTS

| | | | | | |
|---|---|---|---|---|---|
| 630,485 | A | * | 8/1899 | Browne | 273/236 |
| 1,978,107 | A | * | 10/1934 | Hoffmann | 273/153 R |
| 2,503,130 | A | * | 4/1950 | Poritz | 434/349 |
| 2,636,496 | A | * | 4/1953 | Hollop | 40/383 |
| 2,763,485 | A | * | 9/1956 | Dial | 273/150 |
| 2,839,857 | A | * | 6/1958 | Teller | 40/721 |
| 3,159,404 | A | * | 12/1964 | Midgley et al. | 273/150 |
| 3,415,590 | A | * | 12/1968 | Adler | 359/489.19 |
| 3,491,715 | A | * | 1/1970 | Longarini | 116/307 |
| 3,546,792 | A | * | 12/1970 | Sherman | 434/96 |
| 3,601,404 | A | * | 8/1971 | Weisbecker | 273/264 |
| 3,680,227 | A | * | 8/1972 | Pavelle | 434/98 |
| 3,892,411 | A | | 7/1975 | High | 273/155 |
| 4,043,056 | A | * | 8/1977 | Savage | 434/96 |
| 4,071,248 | A | | 1/1978 | High | 273/155 |
| 4,114,877 | A | | 9/1978 | Goldfarb et al. | 273/1 R |
| 4,298,200 | A | * | 11/1981 | Kanbar | 273/157 R |
| 4,463,952 | A | | 8/1984 | Rowbal | 273/236 |
| 4,474,371 | A | | 10/1984 | Silbermintz | 273/1 G |
| 4,819,539 | A | * | 4/1989 | Searing | 84/476 |
| 5,018,728 | A | * | 5/1991 | Liss | 273/459 |
| 5,182,616 | A | * | 1/1993 | Roberts et al. | 356/402 |
| 5,769,418 | A | | 6/1998 | Gilbert et al. | 273/157 A |
| 6,022,026 | A | * | 2/2000 | Johnson, III | 273/450 |
| 6,553,704 | B1 | * | 4/2003 | Pigg | 40/734 |
| 6,641,402 | B2 | * | 11/2003 | Boggs | 434/236 |
| 6,702,285 | B2 | * | 3/2004 | Cheng | 273/153 R |
| 6,746,017 | B2 | * | 6/2004 | Yu et al. | 273/273 |
| 7,243,448 | B1 | * | 7/2007 | Zuaro | 40/491 |
| 7,631,873 | B2 | * | 12/2009 | Scriven | 273/273 |
| 7,900,930 | B2 | * | 3/2011 | Donegan et al. | 273/450 |
| 2007/0108701 | A1 | | 5/2007 | Gu et al. | 273/153 R |
| 2008/0157471 | A1 | | 7/2008 | Darling | 273/292 |

* cited by examiner

*Primary Examiner* — William Pierce
(74) *Attorney, Agent, or Firm* — Michael E. Mauney

(57) ABSTRACT

A target pattern recognition and matching game using a game box, game slats, and a target pattern. A user is provided with multiple game slats and a game box. There is a predetermined target pattern which a user then tries to match by adding or removing game slats from the game box. The pattern may have multiple rows and columns and be matched by the display in display box of the game slats having the same number of rows and columns. Typically, the front of the game box will be transparent and the rear of the game box will be a predetermined color and then may appear on the target pattern and on portions on the game slats used to play the game. The rules of the game and the apparatus of the game may be adjusted to provide a very simply played game for young children or people who have mental impairments to much more complex patterns to provide a much more challenging game for advanced players. It may be played electronically on a computer or using a game program.

16 Claims, 12 Drawing Sheets

PATTERN RECOGNITION AND DUPLICATION PROCESS AND GAME

FIELD OF THE INVENTION

This invention relates generally to using the pattern recognition and duplication potential of individuals both to play a game with specific templates or tools and potentially to provide security for Internet applications or computer processes.

BACKGROUND OF INVENTION

A variety of puzzles or games are known in the art. Among these types of games can include the completion of a pattern following set rules. The well known game "Sudoku" number puzzle is now widely distributed in newspapers as a daily puzzle. A crossword puzzle is a different type of game that uses letters laid out in a grid where missing letters have to be supplied on the basis of clues to form words suggested by the clues.

A number of games have been suggested that involve using an apparatus to form patterns. For example, High, U.S. Pat. Nos. 4,071,248 and 3,892,411, involves a game board with outlying pieces. The outlying pieces can be rotated or manipulated into a central area to form a particular design. Silbermintz, U.S. Pat. No. 4,474,371 is a Rubik™ cube-type game for two people. Again, it involves a manipulation of pieces to form a particular desired pattern. Darling, U.S. Application #2008/157471 is written broadly but apparently is directed toward an alternative way of playing a poker game. Game pieces are randomly dealt to players and with these randomly distributed pieces, players individually or collectively try to match a predetermined pattern. The '471 application suggests a poker straight is the kind of pattern that one may try to match. Despite this earlier work there is still an unmet need for a game that can be played simply with a player's pattern recognition and duplication skills.

SUMMARY OF THE INVENTION

The current invention can be played competitively between two or more players, or a single player can play it and attempt to match a pattern with the least number of moves or the most effective number of moves. The game can be played with game boxes and supplied pieces or it can be played virtually on a computer generated "game box" with computer generated "game pieces." Simplified forms of the game could be used to provide secure access to e-mail or an Internet site in order to make it more difficult for computer programs to automatically access the site. The current invention requires visual acuity to recognize a pattern and game pieces, then use the game pieces to duplicate the desired pattern. It is difficult, if not impossible, for current computer programs to use vision to meet the requirements of using of the game pieces to duplicate the required pattern.

When played as a recreational game, the game has a game box for each player. The game box has a transparent front and an opaque back. The back of the box is a predetermined color. White is the preferred color. The box is square when viewed through the front transparent window toward the white back wall of the box. Across the top of the game box are slots, for example three. In the interior of the box there are vertical dividers which divide the box into columns. Playing slats are provided to players. Each slat is sized to fit within the slot at the top of the box and slide from the top of the box to the bottom of the box within a vertical divider that divides the box into columns. Ordinarily the slats are made of a transparent material. Color blocks may be placed upon the otherwise transparent pieces. By sliding the slat pieces into the box, the colored portions of the slat pieces begin to form a colored pattern when seen through the front transparent wall of the game box. Because the game slats have blocks of color appearing along their lengthwise dimension, the insertion of the slats into the game box results in a different pattern perceived through the transparent front of the game box. At the start of the game a target pattern may be drawn randomly or otherwise chosen for the game players. The object of the game is to match the target pattern by successively inserting, removing, and rearranging slats in the slots at the top of the game box until the view through the transparent front of the game box matches the target pattern. A plurality of game slats with opaque and transparent sections on each slat are distributed to players who, using their visual and analytical skills, perceive how each slat can contribute to the overall construction of the desired target pattern that each player is trying to achieve. Even though the target pattern is a two dimensional flat pattern, the game box requires the players to use depth to construct the target pattern. The combination of different slats with opaque, transparent, and color, along with the depth of the box, allows for many variations for a player to duplicate the target pattern. If the game only had one level of slats in the box, one player could have a significant advantage over another player by luck of the draw. Because of the levels used to create the "flat" front view pattern, a player's skill and imagination can allow them to compete with players who may have had "easier-to-play" slats. The game method utilizes a box to force players to use depth to create 3 dimensional arrangements of game slats which match the 2 dimensional target patterns. Wide variations are permitted in the rules of the game without departing from these essential features.

DETAILED DESCRIPTION OF THE DRAWINGS

Figure 1:
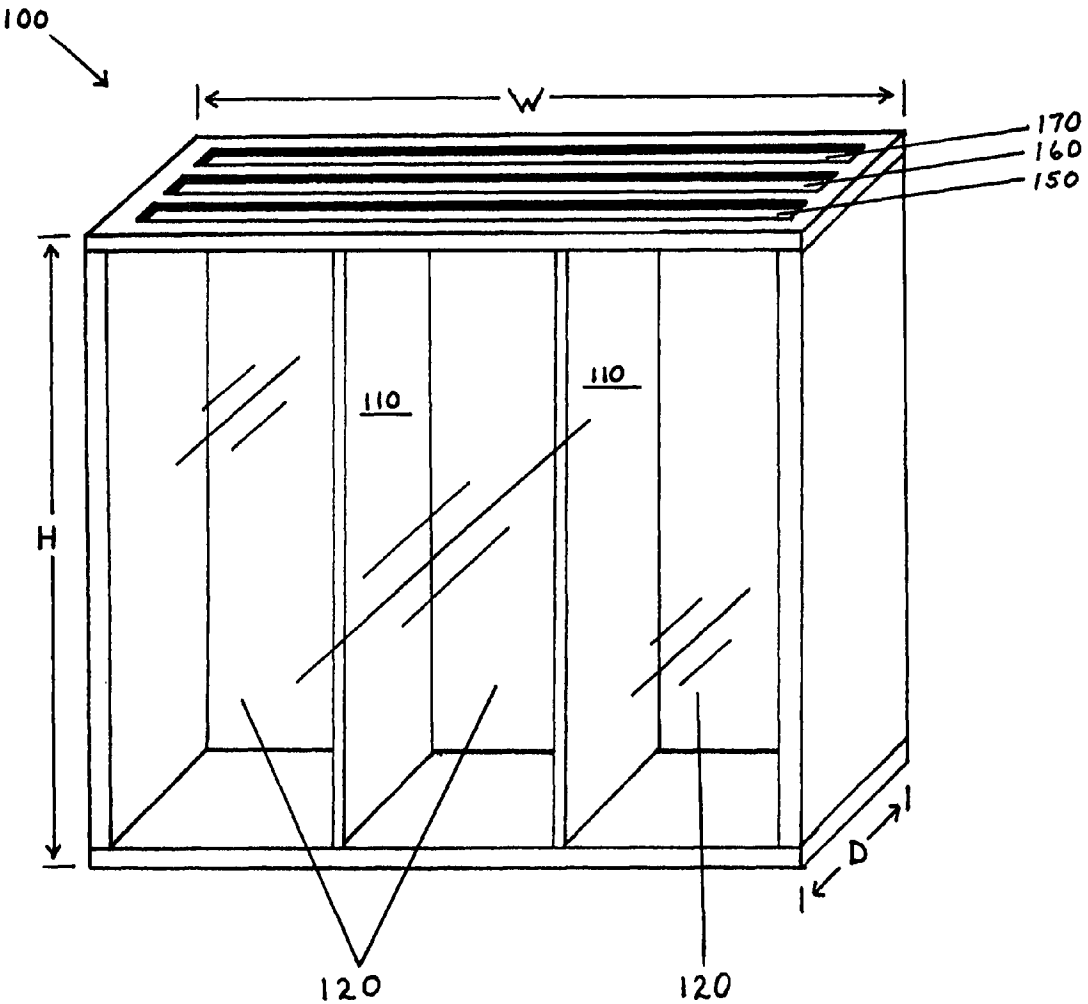
FIG. 1 is a prospective view of the game box portion of the current invention.

FIG. 1 is a prospective view of the game box (100). The game box (100) is a roughly rectangular box which, in the height (h) and width (w) dimensions is approximately square, with a depth (d) dimension ordinarily smaller than the approximately equal height (h) and width (w) dimensions. There is a rear wall (120) to the game box (100). Dividing the game box (100) into approximately three equal columns are vertical partitions (110) which extend from the front to the rear of the box (100) and from the top to the bottom of the box (100). The front wall of the box (100) may be transparent or it could even be open. In any event, in the preferred embodiment of this pattern recognition game it is necessary that the front wall of the game box (100) be transparent so that the interior of the game box (100) may be readily viewed by a player of the game. Across the top of the game box (100) is a widthwise front slot (150) which is in closest proximity to the front transparent wall of the game box (100), a middle widthwise slot (160), and a rear widthwise slot (170). The rear slot (170) is in proximity to the rear wall (120) of the game box (100) with the middle slot (160) placed between the front slot (150) and the rear slot (170).

Figure 2:
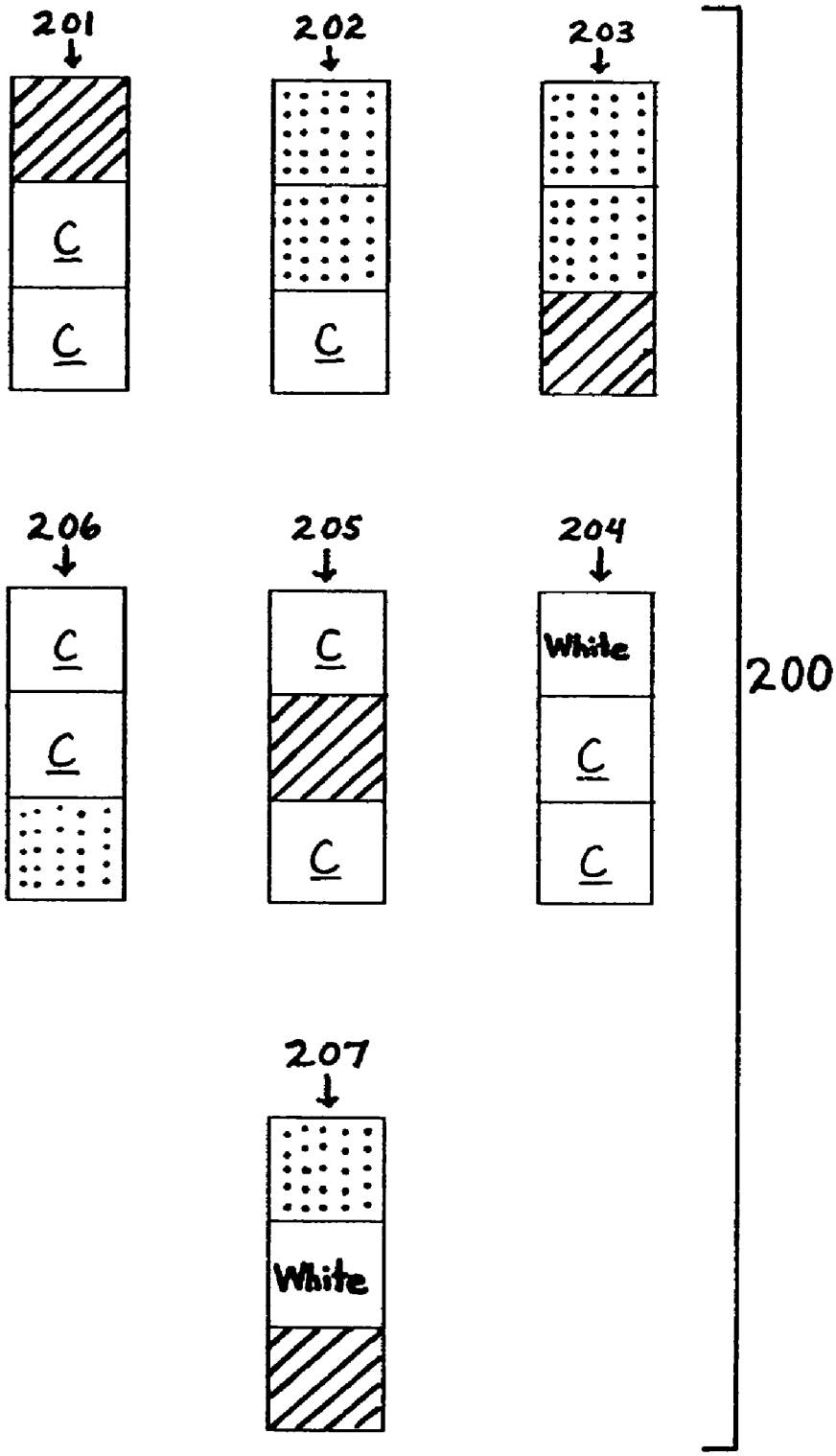
FIG. 2 shows a simplified exemplar of game slats.

FIG. 2 shows simplified exemplars of game slats (200). The term "game slats" is used to apply generally to any game slat no matter how configured, but specifically configured game slats have individual numbers, respectively game slat (201), game slat (202), game slat (203), game slat (204), game slat (205), game slat (206), and game slat (207). The construction of the game slats (200) are similar. Here, game slats (201-207) are shown with dividing lines for explanatory purposes, although no dividing lines are required on the game slats (200) used in a game. In game slat (201) the top section is shown as lined, which could represent a color or pattern. The remaining portion of the game slat (201) is marked with the letter (C) which indicates this portion of the game slat is clear or transparent. For game slat (202) the two portions are shown with polka dots, which could indicate another color or another pattern, while the third portion is marked with a (C) indicating it is clear. Game slat (203) is delineated with polka dots and lines. Game slat (204) has a portion labeled with the word "white" to indicate this portion is colored white. It is colored white to match the white rear wall (120) of the game box (100). Game slat (207) has a top portion polka dotted, a middle portion colored white, and a bottom portion lined. It will be appreciated that game slats (201-207) are exemplars. A set of preferred embodiment of game slats (200) of this invention is shown in other figures. An actual game could have more game slats (200) than shown here with a variety of colors or configurations distributed along the game slats (200). For game slats (200) with one portion of the slat colored, for example (207), the opposite unseen side could have a different color. These game slats (201-207) are simplified exemplars used for explanatory purposes to explain how the game works.

Figure 3:
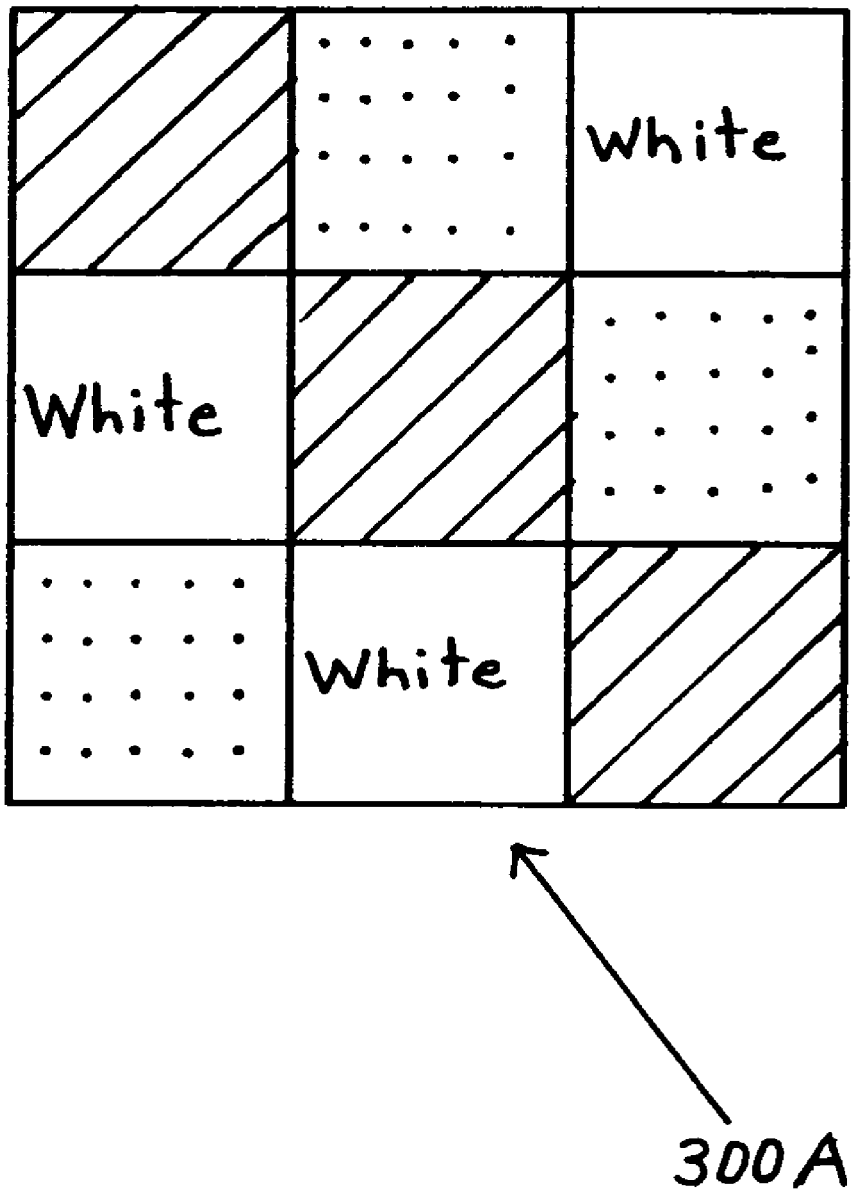
FIG. 3 shows a simplified exemplar game pattern.

FIG. 3 shows a simplified exemplary target pattern (300A). The term "target pattern" (300) is used to apply generally to any target pattern no matter how configured while specifically configured target patterns have individual numbers. A target pattern (300) is the pattern that a player tries to match by insertion of game slats (200) within the slots (150, 160, 170) on game box (100). The exemplar target pattern (300A) is divided into a 3×3 square matrix with each subdivision of the nine subdivisions having a separate pattern or color. Note that target pattern (300A) has lines, polka dots, and white patterns. To explain how the game works consider FIG. 4.

Figure 4:
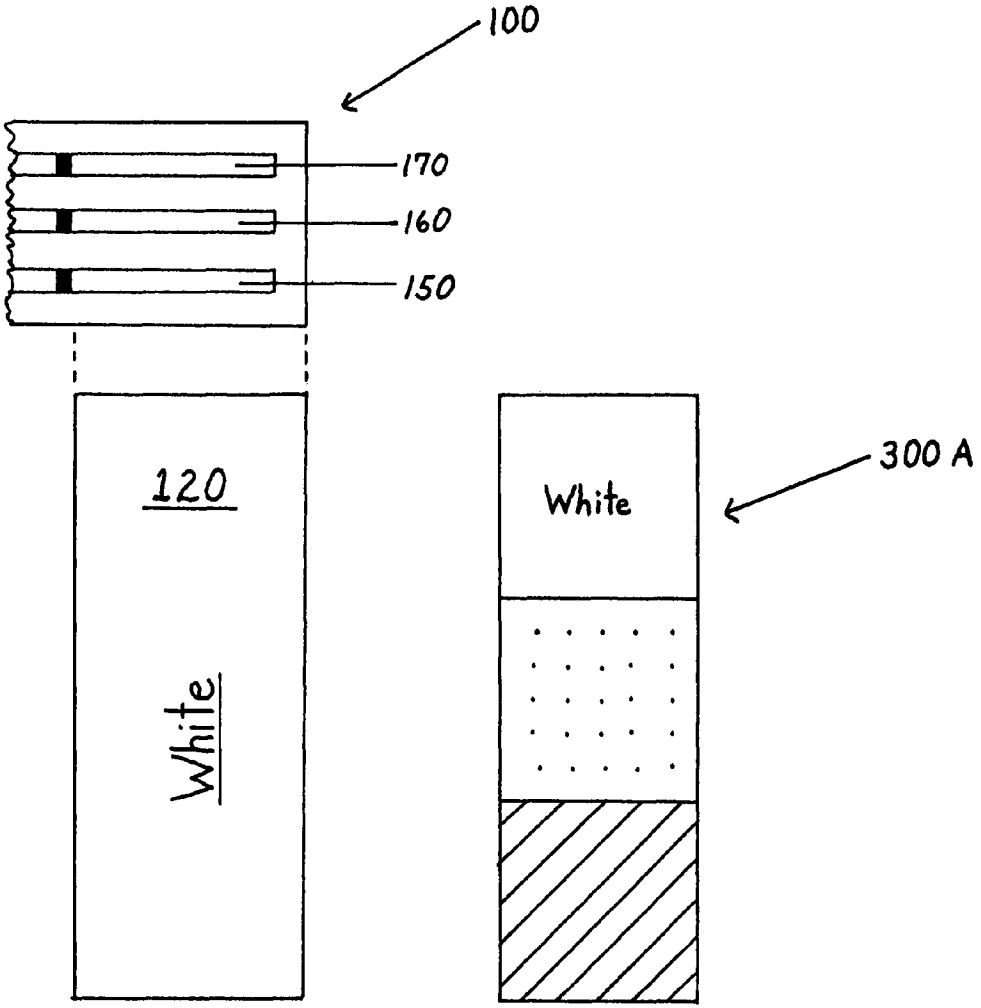
FIG. 4 shows a detail of a game box and a detail of a simplified exemplar game pattern to demonstrate play of the game.

FIG. 4 shows in detail for explanatory purposes a simplified portion of an exemplar game. Only the right column of the game box (100) is shown. Immediately above the right column labeled "white" is shown a cutoff portion of the top of the game box (100) connected by dotted lines to game box (100) shown below it. The right column of the target pattern (300A) shown in FIG. 3 is placed to the right of the game box (100) in FIG. 4 and labeled (300A). The right column of the target pattern (300A) seen in FIG. 3 has in the top portion white color, in the middle portion dots, and in the bottom portion lines. The goal of the exemplar version game is to insert some of game slats (201-207) into slots (150, 160, 170) so as to match the right column of target pattern (300A). Consider how to achieve the right column of target pattern (300A) shown in FIG. 4 portion of the game box (100) shown in FIG. 4. Exemplar game pieces (203 and 207) are lined at the bottom. Consequently, one of these two pieces may be placed within the game box. Three potential positions for these two pieces are in slots (170) at the rear, (160) in the middle, and (150) at the front. However, if either piece (203 or 207) is placed in the front slot (150), it is impossible to match the right column of target pattern (300A). While both game slats (203 and 207) have lining at the bottom neither have the remaining part of the right column of target pattern (300A). If placed in the front slot (150) in the game box (100) the right column of target pattern (300A) cannot be matched. Note also that the right column of target pattern (300A) is white in the top portion. There are two ways one can have white showing to a player of the game through the transparent front of the game box (100). The first is to have clear slats between the viewer and the white back wall of the game box (100). The second is to have game slat with a white portion placed appropriately. Here, game slat (204) will serve to provide a white portion to match the right column of target pattern (300A). Consequently, it can be readily seen that in order to duplicate the required pattern, there are at least two combinations of placement of game slats in slots (150, 160, 170) which will duplicate the pattern. The easiest is to place slat (203) in slot (170). The player will then view through the transparent open part of the game box (100). The lines are seen at the bottom of the box (100). The viewer will also see the polka dots in the middle portion as is required for right column of target pattern (300A). However, in order to achieve the white pattern in the top portion of right column of target (300A), it is necessary to place slat (204) in either slot (160) or slot (150), placing it in front of slat (203) from a viewer's perspective. Because the remaining part of slat (204) is clear, what a viewer will see is first the white portion of slat (204) with the remaining portion being clear, thus viewing middle and bottom portion of slat (203) in the rear slot (170) matching a polka dot middle portion and a lined bottom portion. However, this is not the only way to accomplish this goal. One could also place slat (204) in slot (150), slat (202) in slot (160), and slat (207) in slot (170). Slat (204) will provide the white portion in the front slot (150), slat (202) will provide the polka dotted portion in the middle part of right column of target (300A), and slat (207) will provide the bottom lines portion in slot (170). However, note that this way requires three slats to complete the pattern whereas the previous combination of (203 and 204) in the appropriate slots only required two slats. If game rules require all slots (150, 160, 170) be filled, then the arrangement ((204) in (150), (202) in (160), (207) in (170)) will work. The foregoing is a highly simplified explanation using exemplars of the game slats to demonstrate how the game works. This exemplar version should not to be mistaken for the preferred embodiment of the game. For example, in the foregoing explanation, slats (203 and 207) were used to match the target pattern because they have lining at the bottom. However, game slat (201) could be turned up-side-down to provide the necessary pattern. Moreover, it is understood that each game slat (200) may have a different look when reversed since any portion of a game slat (200) that is colored may have a different color or pattern on the reverse side.

RULES AND STRATEGY OF A PREFERRED EMBODIMENT

Although not readily apparent from FIGS. 1-4, a slat may have color or pattern on one side of the slat, but not necessarily have the same color or pattern on the opposite side of the slat. For example, as shown in FIG. 2, game slat (203) has a pattern with dots in the top two sections and lines in the third section. However, on the opposite side of slat (203) it could be quite different, for example having horizontal lines at the top, white in the middle, and dots at the bottom. Of course, any portion of the slat (200) that is clear; for example, the bottom portion of slat (201), will remain clear. But any portion of a slat (200) which has a color or pattern on it may have a different color or a different pattern opposite from the pattern that is perceptible to a player viewing the apparatus side of the slat.

Because slats (200) are used to duplicate the target pattern (300), how the rules of the game determine a particular player is to be allocated slats (200) to play the game is important in the subsequent play of the game. It is anticipated that ordinarily a target pattern is chosen at random from a set of target patterns (see FIGS. 5 and 6). For example, the group of available slats (200) could be randomly distributed into two separate piles and each player given one pile of slats (200) for use. Alternatively, the slats could be treated like a deck of cards where players alternate to draw one slat from the top without either player knowing in advance how the slats (200) will be arranged in the pile from which slats will be drawn. Different ways of determining the distribution of the slats at the start of the game may emphasize different aspects of a player's skill. In addition to pattern recognition and judgement about how to arrive at a target pattern (300) with the most appropriate arrangement of the slats (200), memory could also play a role. What follows is a preferred embodiment of game rules. It will be appreciated as shown in these game rules there can be two players, but there could also be two teams where more than one player could be on each team. It will be appreciated that in this set of rules, the game requires that nine slats be initially placed in the box and that nine slats always remain within a box until the target pattern (300) is matched. However, there could be variations of the game which start with an empty box and then a player uses one's slats to match the target pattern with the predetermined number of slats required.

Preferred Embodiment

Rules of Game

Number of Players-2

Equipment—2 game boxes (100), numerous target pattern (300) cards, 32 slats (200), and a card stand.

Object of Game—To be the first player to duplicate the target pattern (300) with the 9 slats (200) in his game box (100).

Play—Play begins by one player randomly choosing a target pattern card (300) and placing it in the card stand. The other player shuffles and stacks the slats (200) placing them so that both players can draw from the stack.

The player who chose the target pattern card (300) will begin by drawing the top slat (200) from the stack of slats (200) and placing it in his game box (100). This is repeated by each player alternately until his game box (100) is full. While filling the 2 game boxes (100) with the slats (200), players may not switch, rearrange, or check slat (200) patterns. Each player must take a slat (200) from the top of the slats (200) during his turn. Once the game boxes (100) are full, if either player has duplicated the target pattern (300), he is the winner (very unlikely). If both have duplicated the target pattern (300) it is considered a tie. If neither player has duplicated the target pattern (300), play continues as each player takes a turn which will consist of one of the following moves:

1. Lift a single slat (200) out of one's game box (100) to check its pattern. Player may reverse, rotate, or invert the slat (200) before returning it to the box.

2. Switch the location of any 2 slats (200) in one's game box (100). Player may invert or flip the slats (200), if he wishes, before returning the slats (200) to the game box (100).

3. Remove any slat (200) from one's game box (100) and replace it with the next slat (200) from the top of the slat (200) pile. The discarded slat (200) is placed in a discard pile and may not be drawn.

4. Discard the top slat (200) in the stack. Place this slat (200) in the discard pile.

Note: If the draw pile of slats become depleted, the discard pile should be shuffled and returned to the play.

The first player who duplicates the target pattern (300) is the winner. A player must have 9 slats (200) in his box to win. If multiple games are being played, the winner of the previous game goes first in the next game.

Figure 5:
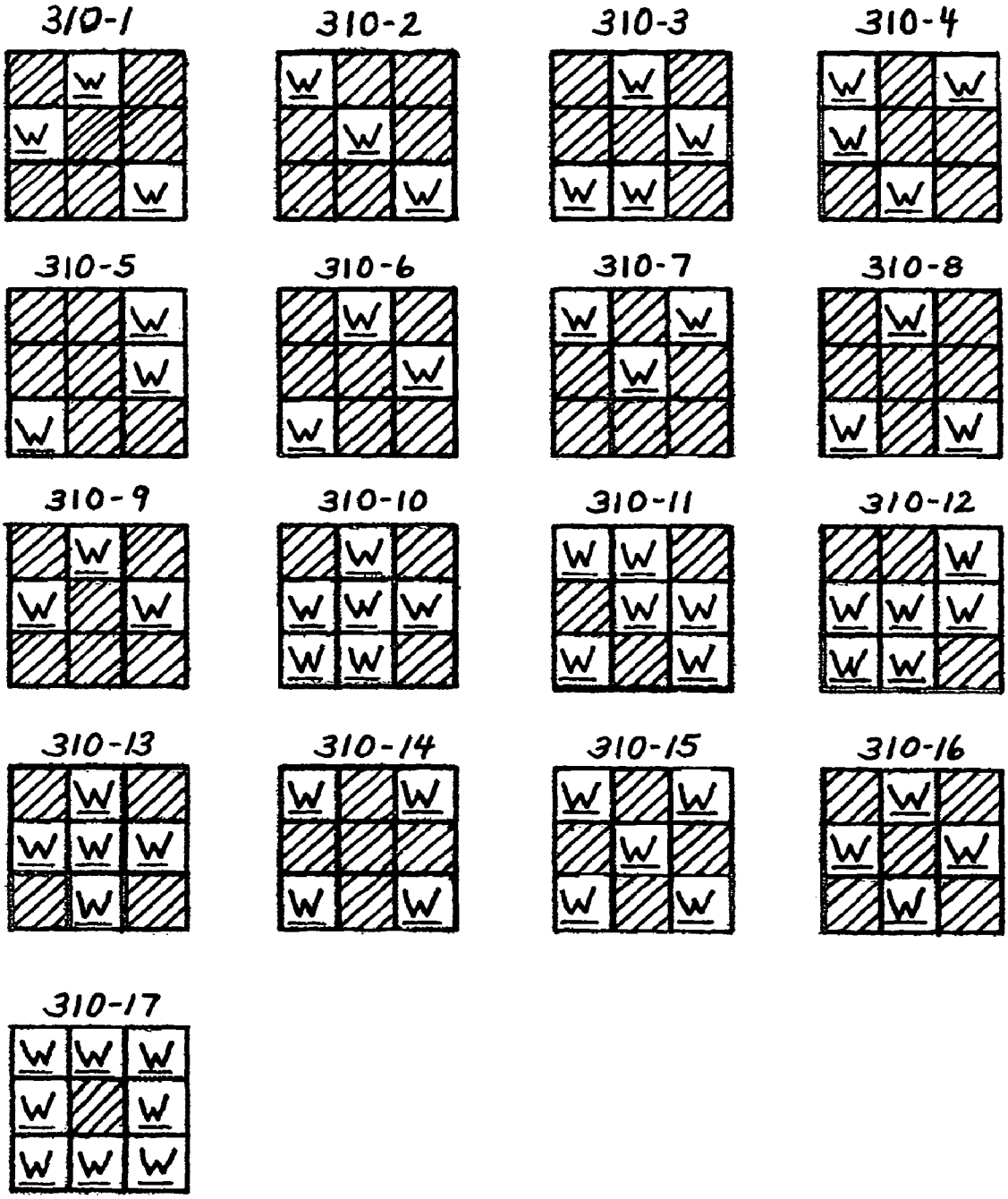
FIG. 5 shows types of target pattern cards.
Figure 6:
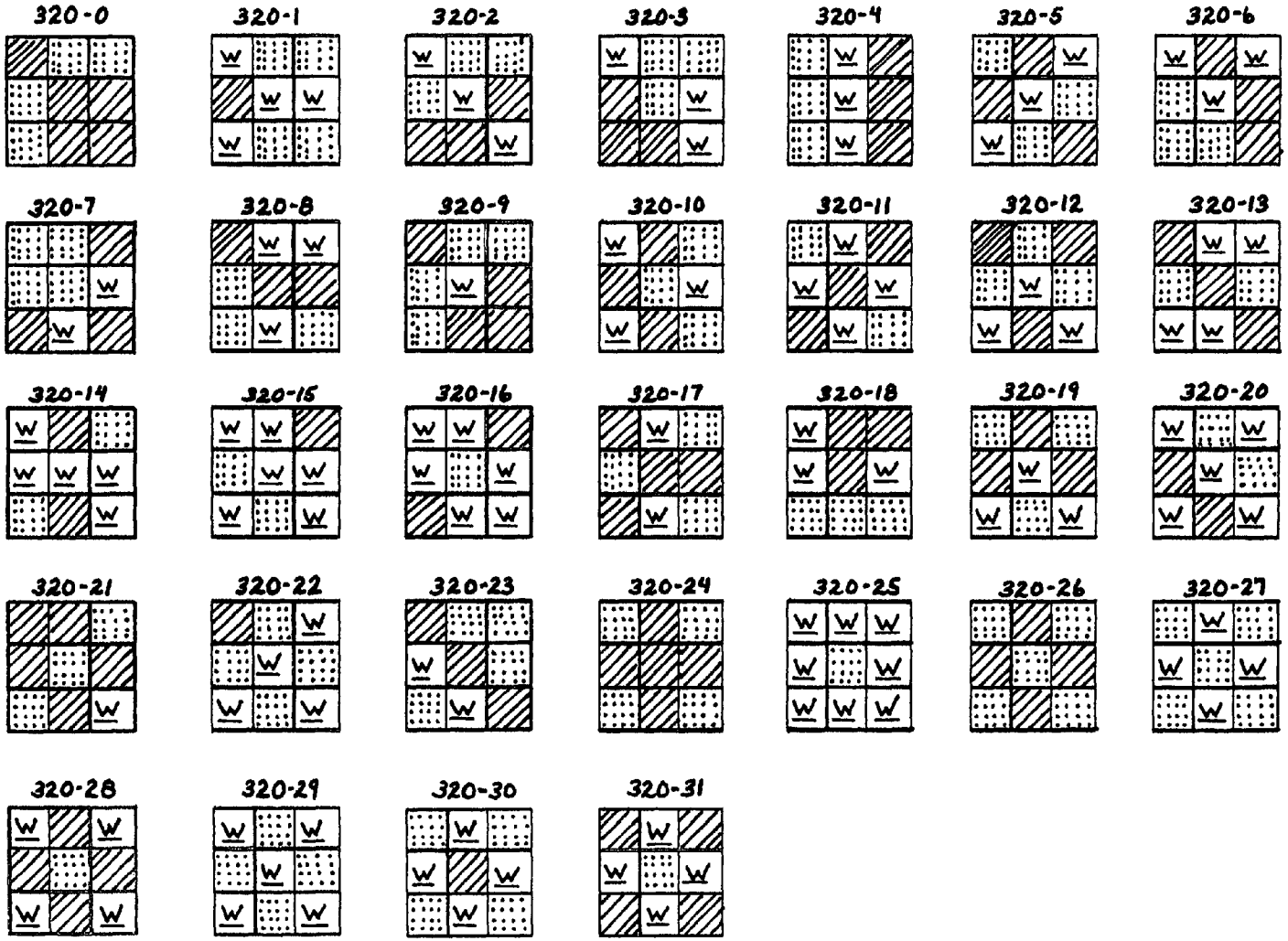
FIG. 6 shows a second type of target pattern cards.

Preferred embodiment types of target pattern (300) cards are shown in FIGS. 5 and 6. In FIGS. 5 and 6, labeling numbers for particular target pattern cards (300) are shown individually above the target pattern card assigned that number without lead lines. FIG. 5 is for target patterns (300) that only have two colors or patterns while FIG. 6 is for target patterns (300) that have three colors or patterns. First, consider FIG. 5. For FIG. 5, the convention is that a color other than white is shown by the lines. It could be any color that does not match the background (120) of the game box (100) whereas the color that matches the background (120) of the game box (100) is shown here as white, and labeled "W". Target pattern cards (300) that have two colors are labeled (310) with a following number. Here, in FIG. 5 there are 17 two-color target pattern cards (310) respectively labeled (310-1) through (310-17). These are a sample of potential target pattern cards but not all of the possible target pattern cards. For example, target card (310-17) has the lines in the center block of 3×3 array on the target card (310-17). However, these lines could appear in any of the other 8 blocks and that would not match any of the remaining target pattern cards (310-1 through 310-16). Consequently, it can be readily seen that FIG. 5 shows only a small sample of the potential two-color target pattern cards (310).

FIG. 6 shows target pattern cards (300) with three colors. Three-color target pattern cards are numbered (320). In FIG. 6 three-color target pattern card (320) are shown with lines and dots representing a pattern or color on the target card (320) whereas the white (labeled "W") portion of the target card (320) would match the background color in the game box (100). Here, there are a total of 32 three-color target cards, respectively numbered (320-0 through 320-31.) Obviously, providing three different color areas on the target pattern card (300) provides a greater variety of potential target cards than is the case with two colors. Again, the three-color target cards (320) shown in FIG. 6 are only a sample of the potential target cards. It will be clear that, depending on how the game slats (200) are made and how the target cards (300) are made, it may be possible to have a very basic game in which it is easy to place game slats (200) in the game box (100) to match the target cards (300) or, alternately, the slats (200) and target cards (300) could be made to make play of the game difficult.

Figure 7:
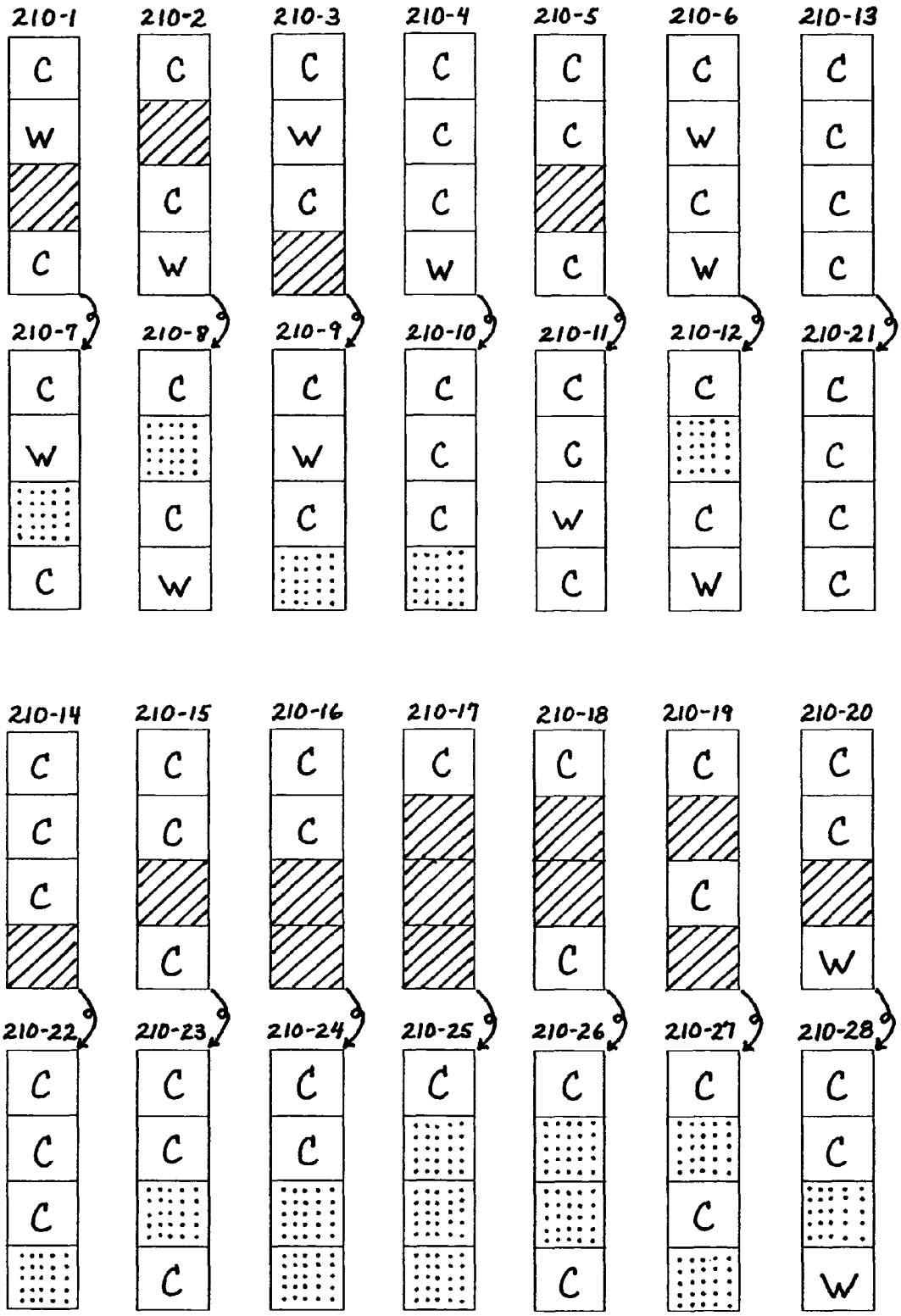
FIG. 7 shows game slats.

FIG. 7 shows a multiplicity of game slats (200), each particular slat is numbered which can be used with either target cards (310) or target cards (320). Note that for each of the game slats shown in FIG. 7, they are either marked with a "C" representing transparent or clear portion of the game slat, with a "W" representing white, in this case the color of the background (120) in the game box (100), with lines representing a particular color or pattern, and dots representing a different particular color or pattern. Each game slat may have a clear portion, a white portion matching the background color (120) and a color or pattern portion. However, no game slat shown in FIG. 7 has two different colors other than white or pattern portions on the same side of the game slats. The game slats are numbered (210-1 through 210-28) representing the total of 14 game slats with game slats (210-1) and (210-7) related in that (210-7) represents one side of a game slat and (210-1) represents the other side of the game slat. The same is true for (210-2) and (210-8) and so on. In each case the game slats have a curved arrow indicating that they are in effect the reverse side of each other. Because there are at least nine slats required to complete a game box and there are two game boxes, a total of 18 slats of one kind or another are required. However, there is no requirement that a particular game slat appear only once in the stack of game slats which constitute the set from which a player chooses or is given a game slat to use in his game box. These game slats constitute a preferred embodiment of a set of game slats (200) from which a game is played. For game slats (210-4, 210-5, and 210-6) with reverse sides (210-10, 210-11, and 210-12), there are one each of these game slats. For game slats (210-2 and 210-3) with reverse sides (210-8 and 210-9), there are two each of these game slats. For game slats (210-13 and (210-20) with reverse sides (210-21 and 210-28), there are two each of these game slats. For game slats (210-1, 210-14, 210-15, 210-16, 210-17, 210-18, and 210-19) with reverse sides (210-7, 210-22, 210-23, 210-24, 210-25, and 210-26), there are three each of these game slats. Consequently, in the set of game slats used to play the preferred embodiment of the game, there are 32 total game slats (200). There are 14 separate game slats (200) which, depending on the particular game slat (200), may appear one, two, or three times in the set of game slats (200) from which a player chooses his game slats (200) to play the game.

Figure 8:
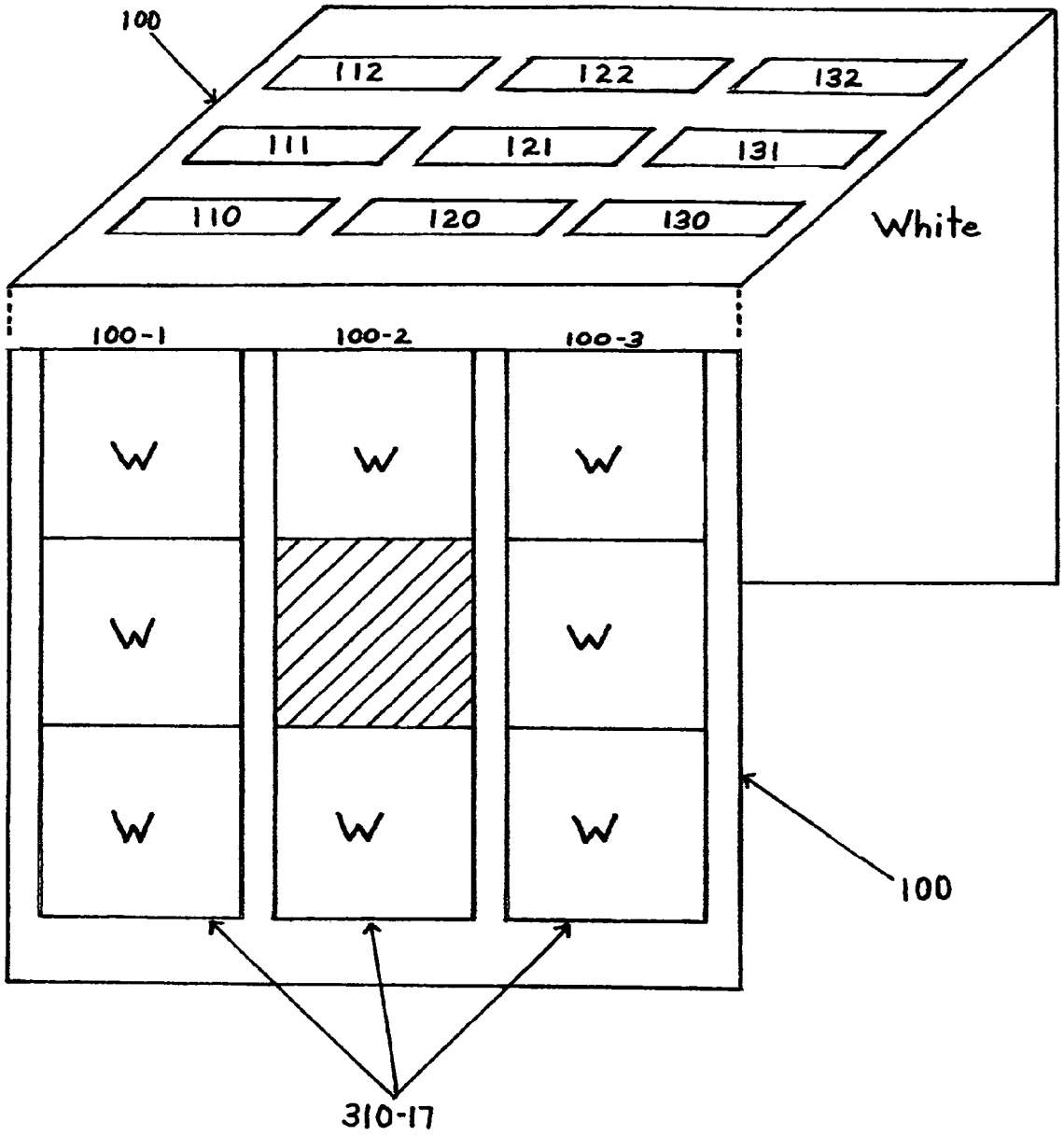
FIG. 8 shows an exemplar of the game box during the play of a game.
Figure 9:
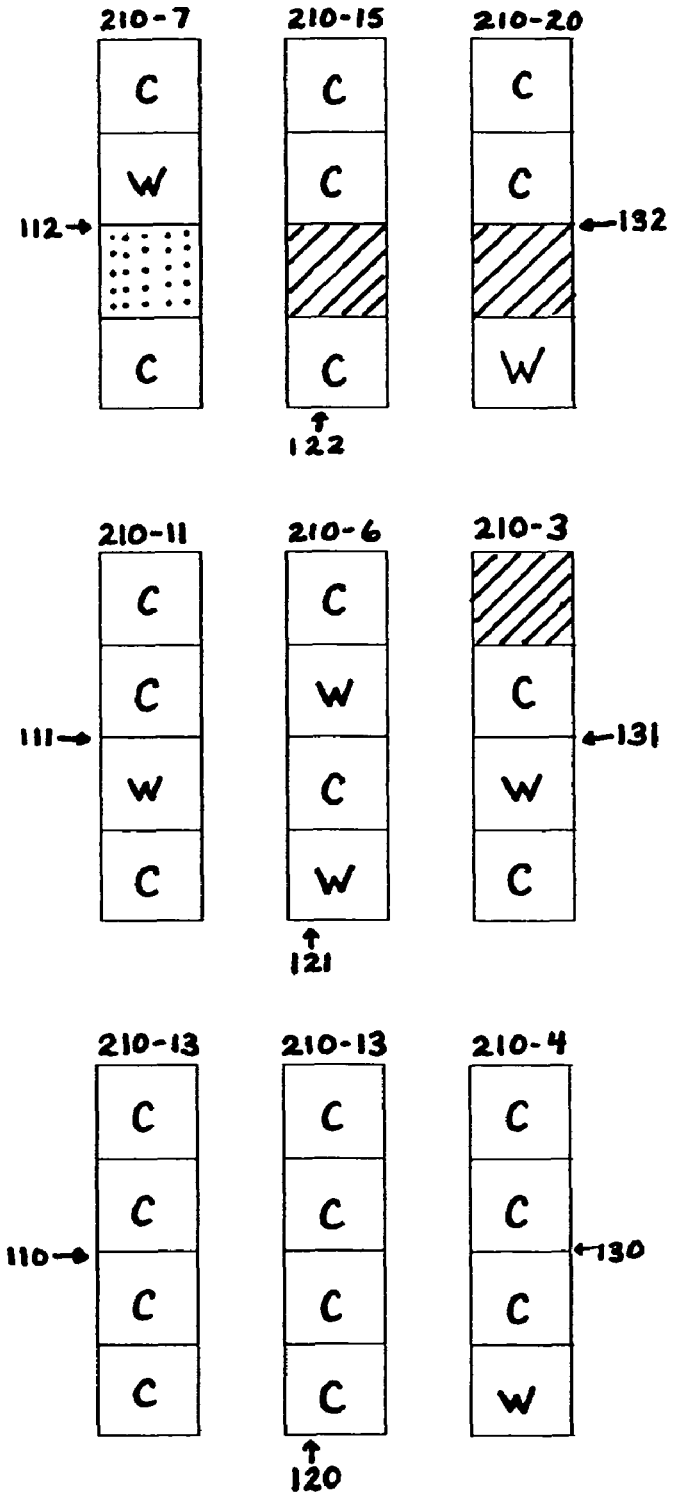
FIG. 9 shows how the game is played using the game slats to match a target pattern card in an exploded game box.

FIGS. 8 and 9 are designed to show how to play a game so that nine particular game slats (200) are inserted into the game box (100) to achieve a particular target pattern (300). The target pattern chosen is target pattern (310-17). Pattern (310-17) is white in eight of the nine boxes with the middle box lines representing either a pattern or a particular color other than white. FIG. 8 shows a game box (100) in a perspective view with the front view flattened for ease of view. The top of the game box (100) is simplified and shown divided into longitudinal holes for insertion of game slats. The holes are numbered (110, 111, and 112) representing a first row of holes. The second row of holes are numbered (120, 121, and 122) while the third row of holes are numbered (130, 131, and 132). The game slats (200) will be respectively inserted into these holes in the top of the game box (100), affecting how the front of the game box (100) appears when viewed through column (100-1), column (100-2), and column (100-3). The object of the game is to make the front view of the game box (100) show the target pattern (310-17) as is shown in FIG. 8. FIG. 9 shows what game slats (200) are inserted into which holes in the top of game box (100) to achieve target pattern (310-17) as shown in FIG. 8. In hole (112) game slat (210-7) is inserted. A clear portion of the game slat (210-7) extends above the game box (100). The three portions in game slat (210-7) that are within the game box (100) and seen through the front column (100-1) are white, dotted, and clear. Since the back of the game box (100) is colored white, if nothing else was inserted in the game box in column (100-1) the viewer would see from the top down respectively white, dots, and white, since the clear portion of game slat (210-7) allows the white background of the game box (100) to be seen. Next, in hole (111) game slat (210-11) is inserted. This is respectively from top to bottom clear, clear, white, and clear. The white portion of game slat (210-11) covers up the dotted portion of game slat (210-7). Consequently, at this point, the view from the front of the game box (100) of column (100-1) is white, white, and white. Consequently, if the rules did not require a further game slat (200) to be placed into hole (110), there would be no need to add another slat to the game box (100) in hole (110). However, in the preferred embodiment of the game, all holes in the top of the game box (100) should be filled with a game slat (200). Consequently, game slat (210-13) could be inserted. Because game slat (210-13) is clear, clear, clear, and clear, it does not affect the view through the front of the game box in column (110-1). Consequently, what is seen in column (100-1) after the slats (210-7, 210-11, and 210-13) are inserted respectively in holes (112, 111, and 110) are three white displays. Next, consider the second column (100-2). In hole (122) game slat (210-15) is inserted, in hole (121) game slat (210-6) is inserted, and in hole (120) game slat (210-13) is inserted. Please note at this point (210-13) has been used twice. However, as was explained earlier, there are two game slats that are configured as game slat (210-13), that is with four clear portions on the game slat. When one inserts game slat (210-15) into hole (122) there are two clear portions which reveal the white background and one lined portion. The next game slat (210-6) has two white portions and a clear portion in the middle. Consequently, after insertion of game slat (210-6) in hole (121), the view of column (100-2) from the front of the box shows a white portion, a lined portion, and a white portion which is the desired configuration. Consequently, the next all clear game slat (210-13) should not and does not affect the view of column (100-2) when inserted into hole (120). Finally, to complete target pattern (310-17) it is necessary column (100-3) be arranged with game slats (200) in holes (130, 131 and 132) so that to a viewer the three portions of column (100-3) all appear white. This can be accomplished in the following way. First, in hole (132), game slat (210-20) is inserted. This slat is clear, clear, lines, and white. At this point a viewer would see in column (100-3) through the two clear portions of the slats a white background with the middle portion lines. Therefore, it is necessary to find a slat which will cover the lines portion with white so that a viewer would see white. This can be accomplished by inverting slat (210-3), so that the lines portion is seen above and outside of the game box (100). This results in the white portion being seen in the middle portion of game box (100) to a viewer's eye, hence covering the lines portion of slat (210-20). One could then insert slat (210-4) into hole (130). Now looking into the front of box (100) one will look through three clear slats in the top portion to the white back wall. Those clear portions of slats are found in (210-20, 210-3, and 210-4). In the second portion one would see first through the clear slat of (210-4) into the white portion of the inverted slat (210-3). Finally, in the bottom portion of column (130) one would see the white portion of slat (210-4). In this fashion, nine game slats (200) are used to fill all nine holes (110-132) in game box (100) and target pattern (310-17) now appears as shown in FIG. 8. The foregoing example is showing how game slats (200) can line up to match a target pattern (300). As was explained earlier in the rules, players would have to take slats off the top of a pile and fill the game box (200). Once the game box is filled, the player would then use four basic moves outlined in the rules earlier to achieve the target pattern.

Figure 10:
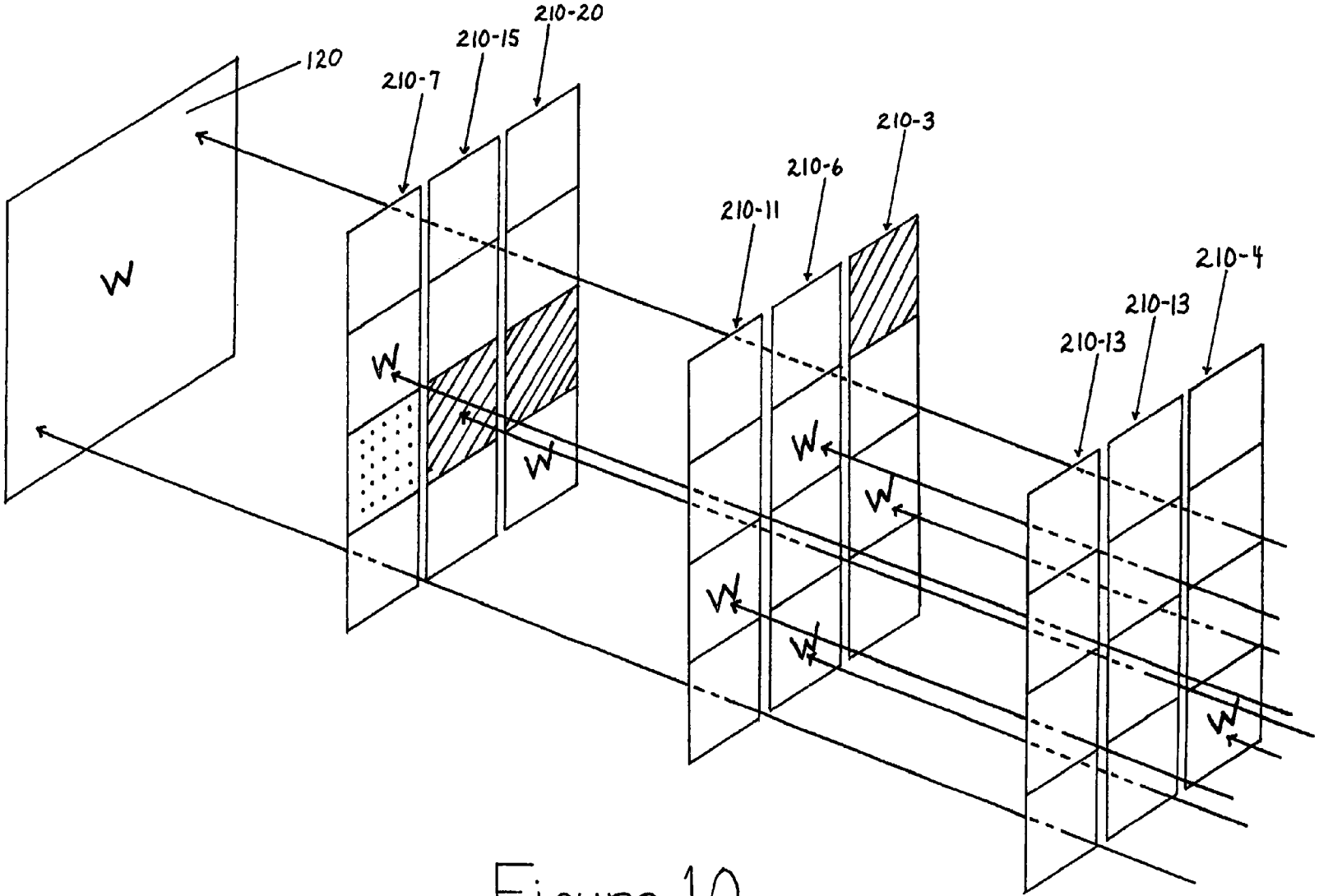
FIG. 10 shows an exploded partial view of game slats in a game box.

FIG. 10 shows an exploded partial view of the slats (200) in position in a game box (100) to duplicate what is shown in FIG. 9 but with a different view. At the upper left portion of FIG. 10 is the back (120) of the game box (100). Respectively arranged in slots (112) and (122) and (132) are slats (210-7, 210-15, and 210-20) The next row of slots (111, 121, 131) have slats (210-11, 210-6, and 210-3). Finally, at the front of what would be the game box are slats (210-13, 210-11 and 210-4) respectively in slots (110, 120, and 130).

Figure 11:
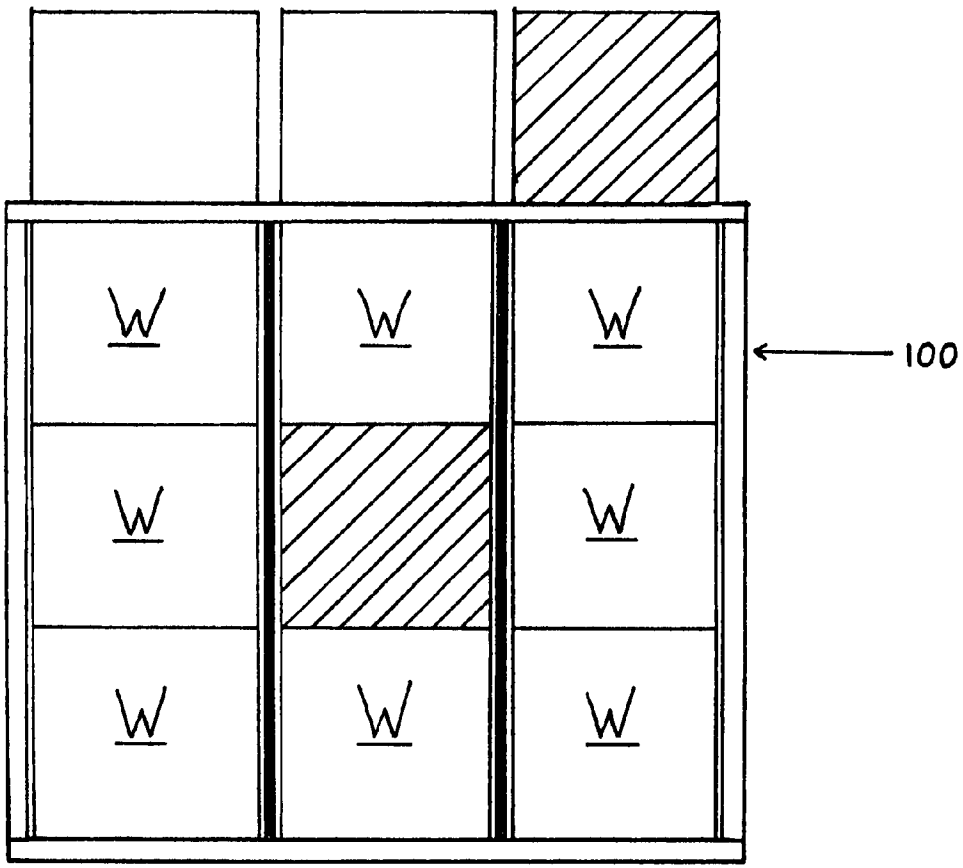
FIG. 11 shows a completed game box with slats in place from front view.

FIG. 11 shows the completed game box (100) of FIG. 7 would look like from a front view. The viewer would see white in eight of the nine viewing portions depending what slats (200) were placed in which slots. In the middle portion of the game box (100) is the lines portion of slot (210-15) placed in slot (122). It will be readily appreciated that for purposes of simplifying the description of how the game is played, a target pattern card (300) was chosen which provides less complex arrangements of the game slats (200) in the game box (100). It is much easier to understand the game when one is actually playing it. One uses the physical embodiments of the game box (100), game slats (200), and target pattern cards (300) as one is learning to play the game. It is more easily experienced than explained.

Figure 12:
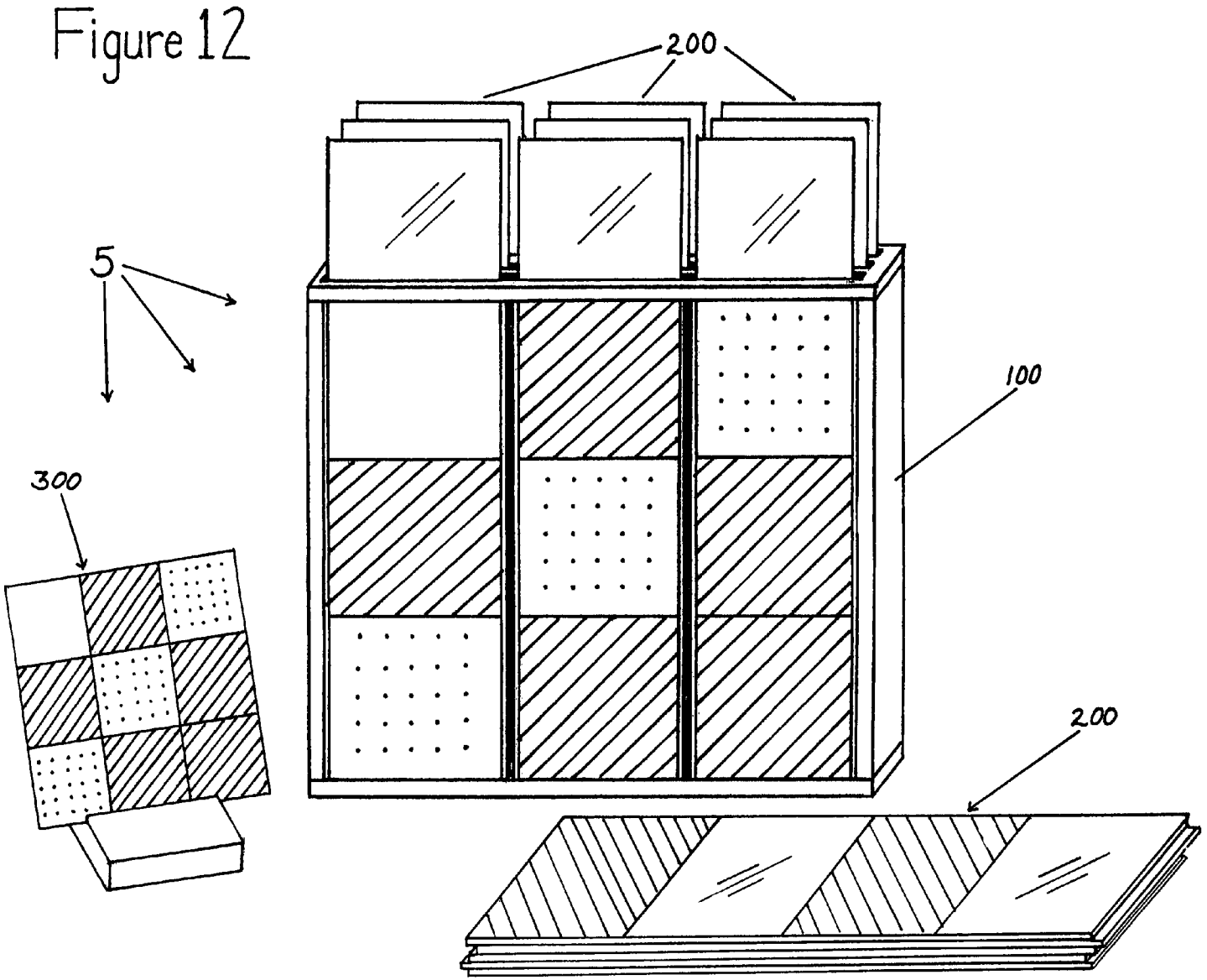
FIG. 12 shows a completed target pattern and duplication game.

FIG. 12 shows the target pattern recognition and duplication game (5) after completion of a game by insertion of the game slats (200) into a game box (100) to match a target pattern card (300). One should note that the target pattern card (300) is matched by the appearance of the front view of the game box (100) by insertion of the game slats (200) into the game box (100) in the appropriate rows and columns. In the process to arrive at the appropriate appearance of the front of the game box (100) to match the target pattern (300), a player may have taken many moves in which slats (200) were inserted into the game box (100) then, at a later time, removed from the game box (100) or rearranged in the game box (100) in accordance with the rules of the game and a player's turn. It will be readily appreciated, like many other games such as Chess or card games, it would be possible using current computer technology to provide for computer play of the target pattern recognition and duplication game (5). There need not be physical embodiment of any of the features of the games but only that there be an appropriate visual representation displayed for a player along with the means to manipulate the visual displays to stimulate a play of a game without using an actual physical embodiment of the game box (100), slats (200), and target pattern (300). Just as one need not have a Chess board with Chess pieces to play a Chess game, a visual representation may be provided with a computer using a mouse, touch screen, or other input into the computer to manipulate the visual display, the target pattern game (5) may be played on a computer.

FIGS. 5, 6, 7, 8, 9, 10, and 11 show a preferred embodiment apparatus used along with the game box (100) of FIG. 1 to play the game. This is used with the preferred embodiment rules described earlier in this application. However, it is apparent that wide variations are permitted in the apparatus and in the rules without departing from the essential spirit of the invention. For example, the target pattern consists of nine distinct blocks in a 3×3 array. However, there is no reason it could not be a 4×4 or a 5×5 array or an asymmetrical array should a more complex and difficult game be desired. By the same token, the game may be played with two or three colors, white, a color represented by the lining, a color represented by the dots as shown on the game slats (200) in the preferred embodiment drawings. However, all could have more colors or one could have patterns instead of colors. The game slats (200) shown in the preferred embodiment have four delineated blocks with either the appropriate colors or with clear portions. However, there is no reason it could not have five or six blocks. This would be especially easy to accomplish in a computer version of the game where slats, game pattern, and game box are all virtual. Other variations in the game rules could permit a player to pick a game slat, not from the set of game slats provided for each player, but rather a game slat from another player's box. All variations are permitted within the basic outlines of the game. The above description of the preferred embodiment is not intended a limitation of the variations permitted within the scope of the inventive concept embodied in this description, but rather the only limitations are in the claims which follow.

I claim:

1. An apparatus for a target pattern recognition and duplication game comprising:

(a) a display box with a front side, a rear side, and a bottom side, and three other sides with; at least a first slot and a second slot in one of three other sides, said at least first slot and said second slot generally parallel to each other, said first slot closer to said front side that said second slot and said second slot closer to said rear side than said first slot, and in said first slot at least two spaced openings defining at least two slot receivers and in said second slot at least two spaced openings defining two slot receivers in said second slot whereby said slot receivers are in a spaced, generally parallel front to rear relationship to each other;

(b) at least four game slats with a predetermined display configuration sized for insertion in said at least four slat receivers;

(c) at least one predetermined target pattern card, said predetermined target pattern card capable of duplication by said game slats when inserted in said slat receivers in said display box;

whereby a user adds or removes game slats in said display box until display in said display box duplicates said target pattern card.

2. An apparatus for a target pattern recognition and duplication game of claim 1 wherein each of said game slats of said at least four game slats is generally rectangular in shape with display side of said game slat divided into at least two square subdivisions with said predetermined display configuration in said square subdivisions on each of said game slats.

3. An apparatus for a target pattern recognition and duplication game of claim 2 wherein for said display box said front side is transparent for transmission of light and said at least four slat receivers arrayed in at least two overlapping rows are spaced for insertion of said game slats whereby said game slats may be viewed by a user through transparent front side of said display box.

4. An apparatus for a target pattern recognition and duplication game of claim 3 wherein display box has opposite from said transparent side of said display box, predetermined color side in said display box wherein one viewing the display side of said display box will see said color side in said display box through said transparent side.

5. An apparatus for a target pattern recognition and duplication game of claim 4 wherein predetermined number of said multiplicity of game slats with a predetermined display configuration has said at least one of said square subdivision colored to match said predetermined colored side.

6. An apparatus for a target pattern recognition and duplication game of claim 5 wherein for said multiplicity of game slats includes at least a predetermined number of said game slats with a predetermined display configuration having at least a portion of said predetermined display configuration transparent whereby a viewer in play of the game may view said predetermined colored side of said display box through said transparent portion of said game slat.

7. An apparatus for a target pattern recognition and duplication game of claim 6 wherein said display box is configured to hold nine game slats in overlapping rows of three each and columns of three each.

8. An apparatus for a target pattern recognition and duplication game of claim 7 wherein said game slat is divided into at least three square subdivisions.

9. An apparatus for a target pattern recognition and duplication game of claim 8 wherein said game slat predetermined display includes on at least one of said game slats a display of a color to match said color on predetermined color side of said display box.

10. An apparatus for a target pattern recognition and duplication game of claim 9 wherein said predetermined target pattern comprises a pattern divided into nine separate portions whereby game slats may be inserted into said game box forming a duplicate pattern with nine separate portions.

11. A method for playing a game to duplicate a target pattern comprising:

(a) providing a display box with a front transparent side a rear side and three other sides with at least a first slot and a second slot in one of three other sides, said at least first slot and said second slot generally parallel to each other, said first slot closer to said front side that said second slot and said second slot closer to said rear side than said first slot, and in said first slot at least two spaced openings defining at least two slot receivers and in said second slot at least two spaced openings defining two slot receivers in said second slot whereby said slot receivers are in a spaced, generally parallel front to rear relationship to each other;

(b) providing a of at least four slats, each of said slats with a predetermined display configuration;

(c) inserting said game slats in said slat receivers arrayed in at least two overlapping rows in said game box;

(d) providing a predetermined target pattern card;

whereby said game slats may be placed in said game box to duplicate said target pattern card.

12. A method for playing a game to duplicate a target pattern of claim 11 wherein said step of providing a predetermined target pattern further comprises providing a predetermined target pattern arranged in rows and columns.

13. A method for playing a game to duplicate a target pattern of claim 12 wherein said slat receivers in said game box are arrayed in a multiplicity of overlapping rows and columns in said game box for receipt of at least one of said game slats in said rows and columns.

14. A method for playing a game to duplicate a target pattern of claim 13 wherein said step of providing multiplicity of slats, each slat with a predetermined display configuration, further comprises game slats generally rectangular in shape with at least one display side of said game slat divided into at least two square subdivisions with said predetermined display configuration in said square subdivisions on each of said game slats.

15. A method for playing a game to duplicate a target pattern of claim 14 further comprises providing a predetermined display configuration for at least one of said game slats wherein at least a portion of said game slat display configuration is transparent.

16. A method for playing game to duplicate a target pattern of claim 15 wherein each of said slat receivers in said game box has to have a slat of said multiplicity of slats placed in said slat receivers in said game box whereby there is no slat receiver without a slat placed therein.

* * * * *